United States Patent [19]

Oldham

[11] Patent Number: 4,838,615

[45] Date of Patent: Jun. 13, 1989

[54] APPARATUS FOR EXCAVATING A RECESS

[75] Inventor: Gerald R. Oldham, Rotherdam, United Kingdom

[73] Assignee: Dosco Overseas Engineering Limited, United Kingdom

[21] Appl. No.: 165,148

[22] Filed: Mar. 7, 1988

[30] Foreign Application Priority Data

Oct. 28, 1987 [GB] United Kingdom ..... 8725285

[51] Int. Cl.[4] ..... E21C 25/16; E21C 31/08

[52] U.S. Cl. ..... 299/73; 173/42; 299/15; 299/75

[58] Field of Search ..... 299/15, 71, 72, 73, 299/74, 75, 76, 78, 54, 59; 173/22, 39, 42, 43, 44; 37/189

[56] References Cited

U.S. PATENT DOCUMENTS

| | | | |
|---|---|---|---|
| 2,390,562 | 12/1945 | Storrs . | |
| 3,306,663 | 2/1967 | Webster | 299/61 X |
| 3,314,722 | 4/1967 | Webster | 299/75 X |
| 3,420,577 | 1/1969 | Pentith | 299/71 X |
| 3,433,533 | 3/1969 | Webster | 299/75 X |
| 3,729,056 | 4/1973 | Paurat | 173/43 |

FOREIGN PATENT DOCUMENTS

| | | |
|---|---|---|
| 562095 | 11/1957 | Belgium . |
| 89185 | 1/1896 | Fed. Rep. of Germany . |
| 1925156 | 11/1969 | Fed. Rep. of Germany . |
| 3141763 | 6/1982 | Fed. Rep. of Germany . |
| 823205 | 1/1938 | France . |
| 487533 | 6/1938 | United Kingdom . |
| 2161848 | 1/1986 | United Kingdom . |

*Primary Examiner*—Stephen J. Novosad
*Assistant Examiner*—David J. Bagnell
*Attorney, Agent, or Firm*—Jones, Askew & Lunsford

[57] ABSTRACT

Apparatus for excavating a tunnel of generally quadrilateral cross-section, the apparatus comprising a cutting head having the head being mounted for rotation about a first axis and a second axis to change the angle of inclination of the cutter. The cutter may be retracted on its support and may be moved transversely of the excavation on a slide, horizontally. It may be moved vertically by mounting the head on an arm pivotally mounted or in another embodiment by mounting the head on a vertically movable carrier carried on a slide. This can be used for excavating by making a set of cuts at various angles; first and second slots are generally parallel at the face but the first slots are inclined to the second, and to the face, so that they intersect. A third set of slots may intersect the first and second sets (for example, vertically) to separate the material from the face in convenient-sized blocks.

10 Claims, 5 Drawing Sheets

APPARATUS FOR EXCAVATING A RECESS

This invention is concerned with apparatus for excavating a recess and is especially concerned with construction of tunnels but is useful whenever it is required to excavate a recess.

Tunnels have usually been constructed by drilling holes, generally parallel to the intended tunnel direction, in a face to be excavated, inserting explosives in the holes and blasting away a short length of the intended tunnel. The resultant rubble is then removed by mechanical shovels, an arch or other support is mounted in the excavated portion and the process is repeated.

In coal mines in particular, it has been known to mill the recesses known as stable holes, which are formed at each end of a coal face. Such techniques are much cheaper and quicker than blasting techniques, but are usable only with soft mineral, such as coal itself. Where hard minerals are met, the blasting technique is normally used in a coal mine.

Another alternative is to use a large drill to drill out the tunnel. The machinery to do this is extremely expensive both to manufacture and to use and expensive techniques have to be utilised to flush out the drilled material and to dispose of the material.

In U.S. Pat. No. 2,390,562 a method of excavating a recess in a given direction in a face is disclosed. The method comprises cutting a series of slots in the face at an acute angle to said given direction, there being a first and second set of such slots, the first and second sets being generally parallel at the face, the slots of the first set being inclined to the slots of the second set so that they intersect one another whereby blocks of material are separated from the face. The first and second sets of slots are, as described in the said U.S. patent, cut in a horizontal direction. Although the said U.S. patent specification describes this method of excavating a recess there is no disclosure therein of any apparatus for carrying out the method and, so fas as the applicants are aware, no apparatus for carrying out such a method has been proposed in over 40 years since the issue of the U.S. patent.

The invention provides, in one aspect, apparatus for excavating a recess in a given direction in a face by a method in which a series of slots are cut in the face at an acute angle to said given direction some of the slots being inclined to others of the slots whereby to separate blocks of material from the face, the apparatus comprising cutting means, a support for the cutting means having first drive and guide means for guiding the cutting means into the face, second drive and guide means for moving the support to cause the cutting means to traverse the face so as to cut a slot in the face, angle setting means for setting the cutting means to cut said slots at an acute angle to said given direction, and adjustment means for moving the support to cut a series of slots wherein some intersect others and are inclined thereto for separating blocks of material from the face, the adjustment means being so constructed and arranged as to move the support so that the slots cut by the cutting means as it is traversed across the face by the second drive and guide means are generally parallel at the face, the angle-setting means being adjustable and the apparatus being constructed and arranged to operate to cause each alternate slot to be inclined to the intervening slots.

Preferably, the adjustment means permits the support to be rotated for cutting slots which intersect with said generally parallel slots at the face.

Preferably apparatus in accordance with the invention comprises continuous operable conveying means for removing separated blocks in the region of the face.

In a first apparatus in accordance with the invention, said adjustment means may be arranged to move the support on a path substantially perpendicular to said given direction; the adjustment means may comprise a carriage, suitably movable along a guide extending in the appropriate direction, in which the second drive and guide means is carried, whereby to move the support along said path. In this first apparatus, the angle setting means may also comprise means for pivotally moving the support about a first axis substantially perpendicular to said given direction whereby to set the cutting means for cutting said slots at an acute angle and means for rotating the support about a second axis perpendicular to the first, which also facilitates cutting said slots which intersect with said generally parallel slots at the face.

In a second apparatus embodying the invention said adjustment means may comprise an arm mounted for pivotal movement about an axis extending generally perpendicular to said given direction and by which said support can be moved along an arcuate path generally transverse to said given direction. Suitably the second drive and guide means is carried by the arm at a position remote from the pivotal mounting thereof.

In said second apparatus embodying the invention, the support may be mounted for pivotal movement about an axis parallel with the axis about which the arm is pivoted whereby to adjust the angle at which the cutting means is moved by the first drive and guide means.

In said second apparatus, the support may be mounted on the second drive and guide means for rotation about an axis perpendicular to the axis about which the arm is pivoted.

There now follows a detailed description to be read with reference to the accompanying drawings of first and second apparatus embodying the invention. It will be realised that this apparatus has been selected for description to illustrate the invention by way of example.

Figure 2:
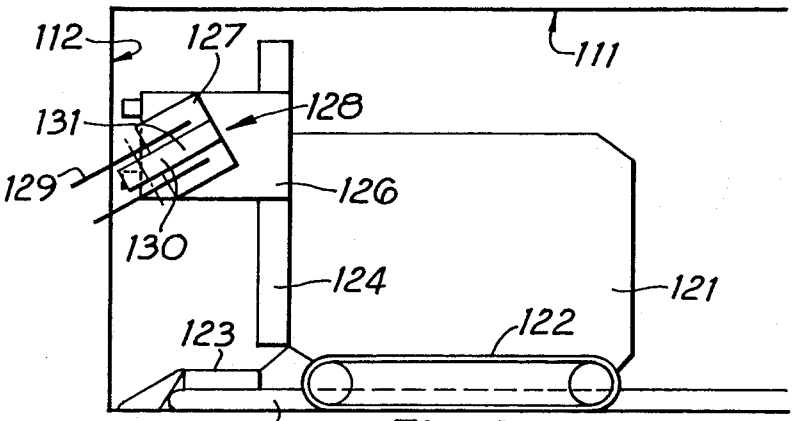
FIGS. 1 and 2 are an end elevation and side elevation respectively of the first apparatus embodying the invention, showing the apparatus in position for cutting horizontal slots in a face.
Figure 1:
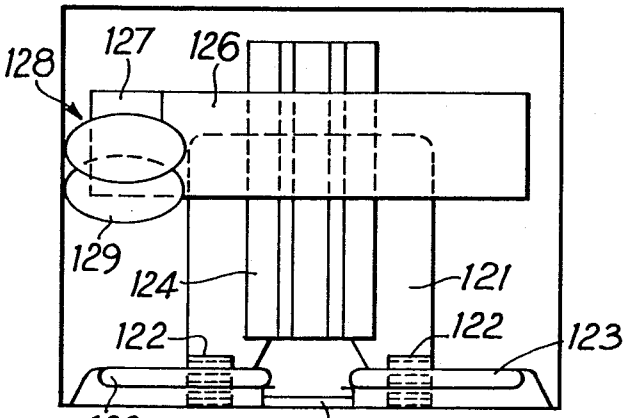
Figure 3:
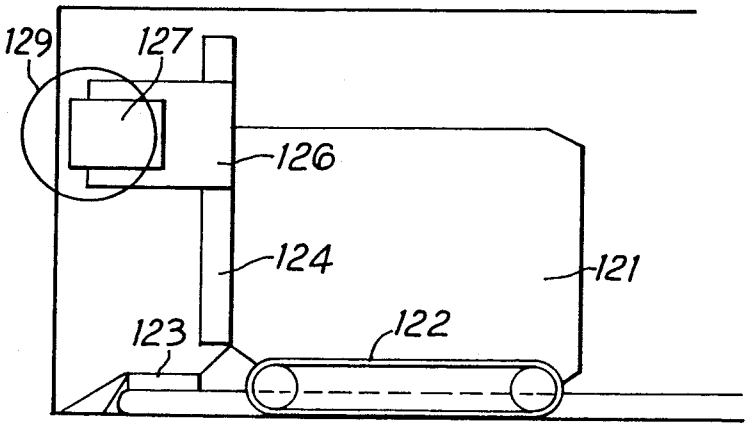
FIG. 3 is a view in side elevation similar to FIG. 2 but showing the apparatus in position for cutting vertical slots.

Referring now to FIGS. 1 to 3, there is shown first apparatus embodying the invention for constructing a rectangular section tunnel 111 by cutting into a face 112.

The first apparatus comprises a self-advanceable body 121 mounted on caterpillar tracks 122. The first apparatus includes conveyors 123, 125 extending in the tunnelling directon.

A vertical guide 124 is mounted on the body and a carriage 126 is movable along the guide. The carriage 126 mounts second drive and guide means which includes a transverse guide which extends substantially the full width of the tunnel. A slide 127 is mounted in the transverse guide for movement therealong by drive means, not shown.

A cutting head 128 is swivellably mounted on the slide about axis 130, so that its rotary cutters 129, provided by high speed diamond saws, can be positioned for cutting either vertical slots or horizontal slots in the face 112. In addition, the head can be angularly moved about an axis 131, perpendicular to the first axis 130, so as to enable the cutters to cut into the face at acute angles to the face 112 at opposite sides of a median plane perpendicular to the face (and parallel with the direction in which the tunnel is being excavated). In addition, the cutting head is movable along the first axis 130.

Figure 4:
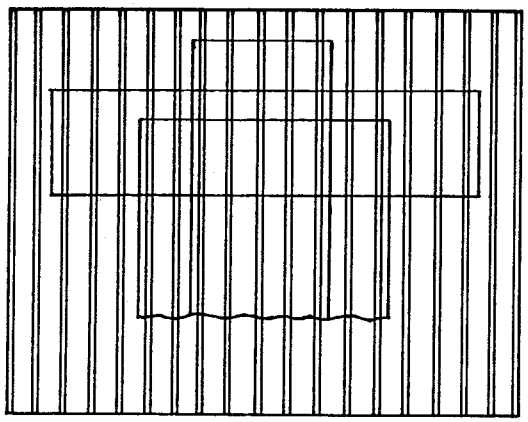
FIG. 4 shows a vertical slot cutting pattern effected by the apparatus of FIG. 3.

The first apparatus is used initially to cut parallel vertical slots in the face 122 at a first acute angle to the face. The cutting head is angularly positioned about the first axis 130 to cut vertical slots and is initially advanced along the axis to permit the cutter 129 to penetrate the face 122. A vertical slot is the produced by movement of the carriage 126 along the vertical guide 124. The cutter is then withdrawn, the slide 127 is moved horizontally along the carriage and another vertical slot is made as before. This procedure is repeated to produce vertical slots over the whole face as shown in FIG. 4. The cutting head is then angularly adjusted about the second axis 131, so that the cutter is again at an acute angle to the face, but also at an acute angle to the first vertical slots. A second set of vertical slots is then cut, each between a pair of first slots at the face, so that the second slots intersect the first slots. This produces columns of rock substantially cut from the face, but held in position at the top and bottom of each column, where the column is integral with the roof and floor respectively.

The columns are then cut into pieces by horizontal cuts, so that blocks fall onto the conveyors 123, 125 and are carried away.

The horizontal cuts are effected starting at floor level, with the carriage 126 at the bottom of the vertical guide 124. The cutting head is swivelled about the first axis 130, so as to be positioned to produce horizontal cuts at the face 112. The cutter is again positioned, however to cut into the face at an acute angle to the face. A series of horizontal cuts is produced by moving the slide 127 along the horizontal guide of the carriage 126 and raising the carriage on the vertical guide 124 after each traverse of the slide.

The partially detached columns are, thereby, completely detached piece by piece and it only remains to detach pieces attached at the edges of the tunnel. This is effected by moving the cutting head about the second axis 131 and cutting slots which intersect the horizontal slots previously produced.

It is envisaged that two banks of cutters may be used to reduce the cutting time in either of the two illustrative apparatuses.

The first apparatus may also be used in a generally similar manner to that described hereinbefore but with the cutting head being adjusted to cut parallel horizontal slots in the face 112 at a first acute angle, thereafter the head being adjusted to cut a second set of horizontal slots at an acute angle to the face and also to the first horizontal slots, so that the second slots intersect the first slots. This produces horizontal blocks of rock, substantially cut from the face but still attached at the opposite ends of the blocks. The blocks can be cut into pieces by vertical cuts to produce smaller blocks that are removed by the conveyors 123, 125 and blocks attached at the opposite sides of the tunnel detached by final vertical cuts, thus producing a tunnel of substantially rectangular cross-section. If desired the vertical cuts may be made first, the intersecting horizontal slots being cut thereafter.

Referring, now, to FIGS. 5 to 8, there is shown a second apparatus embodying the invention for constructing a rectangular section tunnel 111 by cutting into a face 112.

Figure 5:
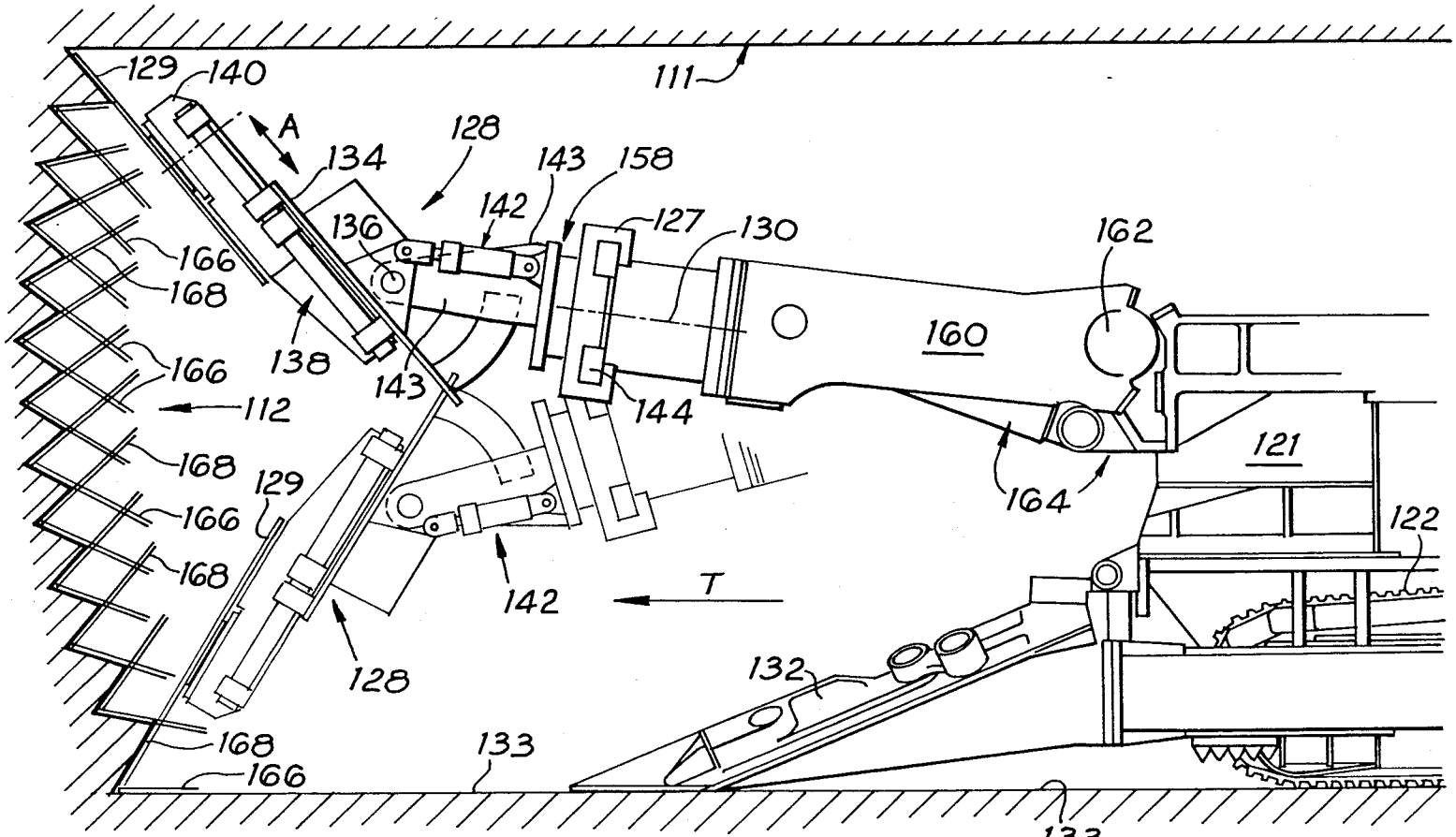
FIG. 5 is a view in side elevation of a second apparatus embodying the invention.
Figure 6:
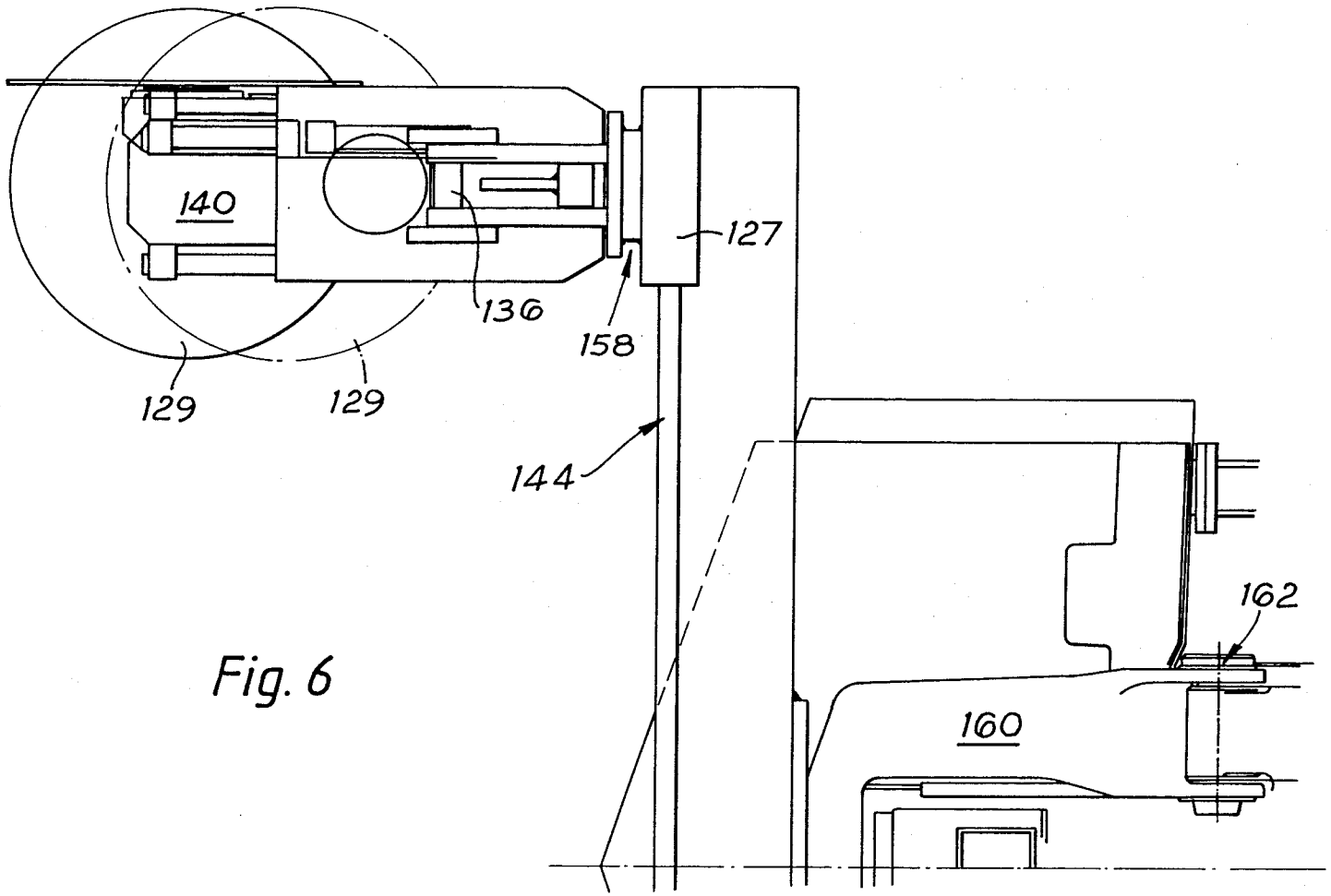
FIG. 6 is a plan view of the second apparatus.

The second apparatus again comprises a self-advanceable body 121 mounted on caterpillar tracks 122. The second apparatus likewise includes conveyors extending in the tunneling direction to remove pieces of rock. In order to provide a stable cutting platform, legs 132 are provided, pivotally mounted on the body 121 so that they can be lifted from the floor 133 of the tunnel when the second apparatus is to be advanced but can be placed on the floor 133 of the tunnel (as shown in FIG. 5) when the apparatus is cutting.

The second illustrative apparatus comprises a cutting head 128 having a support 134 mounted for pivotal movement about a pivot axis 136 carried by a bracket 143 mounted on a slide 127; the slide 127 is mounted for sliding movement on a transverse guide 144 which extends substantially the full width of the tunnel. Support 134 has first drive and guide means provided by a piston a cylinder arrangement 138 arranged to move a bearing member 140 of the cutting head 128 in the direction indicated by the arrows A perpendicular to the pivot 136. A cutter 129, provided by a high speed diamond saw, is mounted by the bearing member 140 and is rotated in the operation of the second illustrative apparatus by a suitable motor (not shown). The cutting head 128 is arranged to be pivotally moved about the pivot 136 by a piston and cylinder arrangement 142 extending between the support 134 and part of a rotary bearing 158 mounted on the slide 127. The slide 127 and transverse guide 144 provide part of a second drive and guide means of the second illustrative apparatus.

Figure 7:
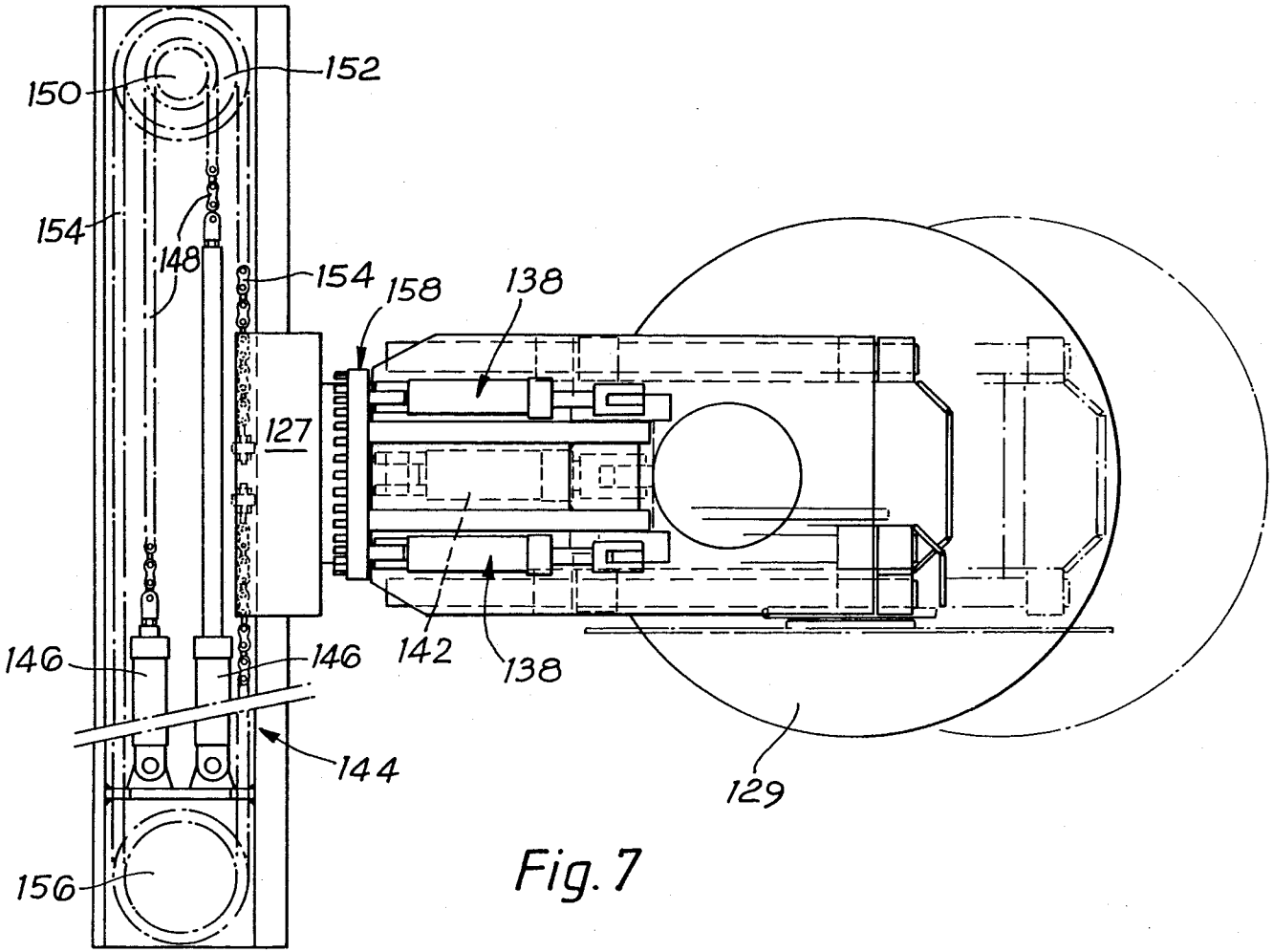
FIG. 7 is a plan view showing cutting means and first and second drive and guide means of the second apparatus.
Figure 8:
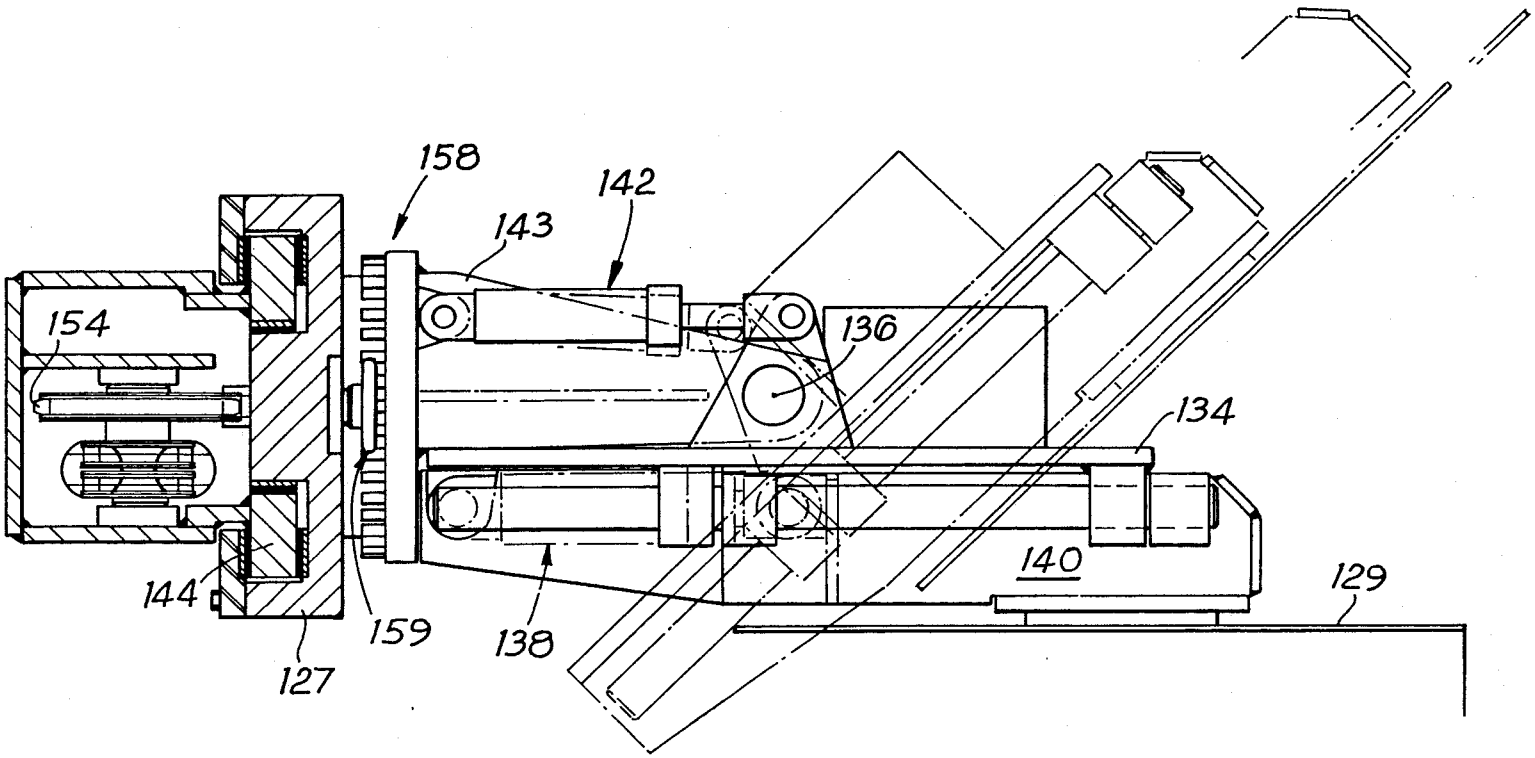
FIG. 8 is a view in side elevation of the parts of the second apparatus shown in FIG. 7.

The drive means of the second drive and guide means comprises two piston and cylinder arrangements 146 of which the cylinders are mounted on the transverse guide 144 and the piston rods of which are connected to opposite ends of a drive chain 148 which passes round a toothed wheel 150 of relatively small diameter (see FIG. 7). The wheel 150 is secured to a shaft to which is also secured a toothed wheel 152 of larger diameter. Second chain 154 surrounds the toothed wheel 152 and an idler wheel 156 at the opposite end of the transverse guide 144 and the opposite ends of the second chain 154 are secured to the slide 127. Thus operation of one or other of the piston and cylinder arrangements 146 is effective to rotate the small wheel 150 and thus the large wheel 152, and through that to move the chain 154 to effect motion of the slide transversely of the tunnel.

The slide 127 mounts the bracket 143 on a member of the rotary bearing 158 so that the bracket 143, and thus the cutting head 128 supported thereby, can be rotated about an axis. The bracket 143 is arranged to be rotated in the bearing 158 by any suitable drive means, for example a rack and pinion system 159.

The transverse guide 144 is mounted at an extremity of a support arm 160 which is mounted for pivotal movement about a pivot 162 carried by the body 121 of the second illustrative apparatus. Pivotal movement of the arm 160 about the pivot 162 is effected by suitable drive means, comprising a piston and cylinger arrangement 164. Second illustrative apparatus may be used to cut first and second sets of inclined slots and intersecting parallel slots in a manner similar to that referred to previously in connection with the first illustrative apparatus.

In a preferred system of excavating, the cutting head 128 is first manipulated by pivoting the support 134 about the pivot axis 136 to an appropriate position and rotating the bracket 143 about the bearing 158 so that the rotary blade 129 lies in a vertical plane. The slide 127 is moved along the transverse guide 144 to one end of the guide and a vertical slot parallel with the intended direction of the tunnel is cut in the face 112 by first sinking the rotary blade into the face 112 by movement in the direction A using the piston and cylinder arrangement 138 and then pivotting the arm 160 about the pivot 162 to move the blade in a vertical direction thereby cutting a slot. Conveniently, the first slot will be cut by pivotting the arm 160 from the lowermost position to an uppermost position. The blade will then be retracted from the slot by movement in direction A and the slide 127 traversed a distance along the transverse guide 144 to a position at which it is desired to cut a second vertical slot. In this way, a series of vertical slots are cut as shown in FIG. 4. The first and last vertical slots define the side walls of the tunnel.

Having cut the vertical slots, the head is rotated in the bearing 158 about an axis 130 (FIG. 5) by the rotating means to move the cutting head from the position at which the pivot axis 136 is at right angles to the direction of the transverse guide 144 to the position in which it is shown in FIG. 5, namely parallel to the transverse guide 144 and the support 134 is pivoted by the piston and cylinder arrangement 142 about pivot axis 136 to set the rotary blade 129 at an acute angle to the face 112, as shown in FIG. 5. A first set of slots, each substantially parallel with the next adjacent cut are cut in the face as indicated in feint line on FIG. 5 identified by the reference 166. The arm 160 is pivoted about the pivot 162 to arcuately move the cutting head to move the cutting blade from one slot 166 to the next. As will be seen by examining FIG. 5 of the drawings, because the cutting head is moved arcuately, the uppermost of the slots 166 is not parallel to the lowermost of the slots; nevertheless, each adjacent slot is only angled slightly differently from the slots at either side of it and may be regarded as substantially parallel thereto in view of the large radius of the arm 160. Nevertheless, by adjusting the angle of the cutting head 122 about the axle 136 using the piston and cylinder arrangement 142 it may be possible to effect a series of precisely parallel slots. However, as can be seen in FIG. 5, it is desirable that the lowermost slot be aligned with the previously cut floor 133 of the tunnel thereby producing a smooth tunnel floor. Having reached the lowermost slot 166, the cutting head 128 is rotated about the bearing 158 through an angle of 180° to the position in which it is shown in feint line in FIG. 5. Having been rotated into this position the rotary blade 129 is used to produce second series of slots 168 which are disposed at an acute angle to the face 112 and intersect first set of slots 166.

In each case, the rotary cutting blade is first driven into the face to be cut by movement in the direction A by the piston and cylinder arrangement 138 and the blade is then traversed across the face 112 by movement of the slide 127 on the guide 144 to produce a substantially horizontal cut. When the blade 129 reaches the end of the first slot to be cut, it is retracted by the piston and cylinder arrangement 138, the arm 160 is pivoted to move the blade to the next cutting position and the blade 129 is again sunk into the face by the operation of the arrangement 138 and traversed back across the face by a return movement of the slide 127 on the guide 144.

It is preferred to make the vertical cuts first and then to make the horizontal cuts starting from the roof of the tunnel and making the slots 166 first then cutting the second set of slots 168 starting from the lowermost cuts: the lowermost blocks of rock falling away from the face 112 can be cleared before the next set of blocks falls.

Blocks will generally be of parallelopiped configuration, conveniently with the long dimension of about 61 cms and the smaller dimension of about 31 cms. It will be appreciated that the angle of the blade 129 relatively to the direction of the tunnel (indicated by the arrow T in FIG. 5) may be any suitable angle conveniently between about 30° and 60°. The first and second sets of slots may likewise be inclined to one another at any suitable angle, conveniently between 60° and 90°. The first and second illustrative apparatuses may be used to cut any excavation of generally quadrilateral shape cross-section. Commonly, such excavations or tunnels are between about 3 to 6 meters wide and between about 2 and 18 meters in height.

The apparatuses for cutting tunnels described above are substantially cheaper to use than existing methods and rock of all types can be cut by the apparatus described. It is only necessary to vary the rotary cutting speed according to the hardness of the rock being cut.

Using this cutting method, described above, the tunnel supports are able to be placed close to the face after each section has been cut. This is not possible with blasting techniques and there is greater safety in using apparatus according to the invention.

I claim:

1. Apparatus for excavating a recess in given direction in a face, the apparatus comprising:

cutting means for cutting a series of slots in the face at an acute angle to said given direction, some of the slots being inclined to and intersecting others of the slots whereby to separate blocks of materials from the face;

a body;

an arm extending from the body;

a support for the cutting means mounted on the arm and having first drive and guide means for guiding the cutting means in a slot-cutting action into the face;

second drive and guide means on the arm for moving the support to cause the cutting means to traverse the face so as to cut a slot across the face;

angle setting means mounted between the cutting means and said support for setting the cutting means to cut said slot at an acute angle to said given direction and said face; and adjustment means for moving the support to cut a series of slots wherein some slots intersect other slots and are inclined thereto for separating blocks of material from the face; and the adjustment means being operative to move the support so that the slots cut by the cutting means as the cutting means is traversed across the face by the second drive and guide means are generally parallel at the face.

2. Apparatus according to claim 1 wherein the adjustment means permits the support to be rotated for cutting slots which intersect with said generally parallel slots at the face.

3. Apparatus according to claim 1 comprising continuously operable conveying means removing separated blocks from the region of the face.

4. Apparatus according to claim 1 wherein the angle setting means comprises means for pivotally moving the support about an axis substantially perpendicular to said given direction.

5. Apparatus according to claim 1 wherein said adjustment means is arranged to move the support on a path substantially perpendicular to said given direction.

6. Apparatus according to claim 5 wherein the adjustment means comprises a carriage by which the second drive guide means is carried whereby to move the support along said path.

7. Apparatus according to claim 6 wherein the support is mounted for rotation about an axis extending in said given direction.

8. Apparatus according to claim 1 wherein said arm is mounted for pivotal movement about an axis and said adjustment means is operable to move said arm pivotably, whereby said support can be moved along an arcuate path generally transverse to said given direction.

9. Apparatus according to any claim 8 wherein the adjustment means is arranged to move the cutting means after each traverse of the face to cut a slot or slots to a position for cutting the next slot or slots whereby to cut a first set of slots, each slot parallel or substantially parallel to the next adjacent slot of the first set, thereafter to adjust the cutting means to cut a second set of slots each parallel or substantially to the next adjacent slot of the second set, the slots of the second set alternating with and intersecting those of the first set.

10. Apparatus according to claim 9 so constructed and arranged as to operate to cause each alternate slot to be inclined to the intervening slots.

* * * * *

UNITED STATES PATENT AND TRADEMARK OFFICE

CERTIFICATE OF CORRECTION

PATENT NO. : 4,838,615

DATED : June 13, 1989

INVENTOR(S) : Gerald R.O. Pentith

It is certified that error appears in the above-identified patent and that said Letters Patent is hereby corrected as shown below:

On the title page inventor should read

--(75) Inventor: Gerald R.O. Pentith, Rotherham, United Kingdom--.

Signed and Sealed this

Ninth Day of October, 1990

*Attest:*

HARRY F. MANBECK, JR.

*Attesting Officer*

*Commissioner of Patents and Trademarks*